US011661164B2

(12) United States Patent
Yazaki et al.

(10) Patent No.: US 11,661,164 B2
(45) Date of Patent: May 30, 2023

(54) OUTBOARD MOTOR

(71) Applicant: HONDA MOTOR CO., LTD., Tokyo (JP)

(72) Inventors: Makoto Yazaki, Wako (JP); Hiroshi Yamamoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 255 days.

(21) Appl. No.: 17/282,003

(22) PCT Filed: Oct. 4, 2018

(86) PCT No.: PCT/JP2018/037190
§ 371 (c)(1),
(2) Date: Apr. 1, 2021

(87) PCT Pub. No.: WO2020/070854
PCT Pub. Date: Apr. 9, 2020

(65) Prior Publication Data
US 2021/0347458 A1 Nov. 11, 2021

(51) Int. Cl.
*B63H 20/24* (2006.01)
*B63H 20/32* (2006.01)
*F02B 61/04* (2006.01)

(52) U.S. Cl.
CPC ..... *B63H 20/245* (2013.01); *B63H 20/32* (2013.01); *F02B 61/045* (2013.01)

(58) Field of Classification Search
CPC ..... B63H 20/245; B63H 20/32; F02B 61/045
See application file for complete search history.

(56) References Cited

U.S. PATENT DOCUMENTS 8,651,906 B1 * 2/2014 Morton ..... B63H 20/32 440/88 R
2007/0054569 A1 * 3/2007 Murai ..... F02M 35/1233 440/77
2017/0370334 A1 * 12/2017 Saiga ..... F02M 35/168

FOREIGN PATENT DOCUMENTS

EP 1182337 A2 * 2/2002 ..... F02B 61/045
JP 2013-024173 2/2013

OTHER PUBLICATIONS

International Search Report and Written Opinion for International Application No. PCT/JP2018/037190 dated Dec. 18, 2018, 11 pages.

* cited by examiner

*Primary Examiner* — Stephen P Avila
(74) *Attorney, Agent, or Firm* — Amin, Turocy & Watson, LLP

(57) ABSTRACT

An outboard motor is provided with: an engine cover in which a first outside air inlet port, an exhaust port, and second outside air inlet ports are formed; and a lower housing that is disposed below the engine cover. The engine cover is provided with a front guide and a rear guide that guide outside air, introduced respectively from the first outside air inlet port and the second outside air inlet ports into the engine cover, downward in the gravity direction.

7 Claims, 10 Drawing Sheets

OUTBOARD MOTOR

TECHNICAL FIELD

The present invention relates to an outboard motor installed in a vessel.

BACKGROUND ART

An engine of an outboard motor heats up due to running, and attains a high temperature. In order to cool this engine, a water jacket provided to the engine is supplied with cooling water (for example, fresh water of a lake/marsh, river or the like, or sea water of a bay, ocean or the like, where the vessel installed with the outboard motor operates).

Moreover, the engine is cooled by outside air too. That is, as described in Japanese Laid-Open Patent Publication No. 2013-024173, a casing in which the engine is housed has formed therein an outside air inlet port and an exhaust port. Outside air that has been introduced into the casing via the outside air inlet port flows through an inside of the casing to cool the engine, after which the outside air is discharged to outside of the casing from the exhaust port. As may be understood from this, the outside air flows through the inside of the casing as cooling air.

SUMMARY OF INVENTION

The vessel is operated on water. Hence, the outside air flowing through the inside of the casing includes much moisture (humidity). There is concern that if a metal-made component is exposed to such outside air, rust will occur.

A main object of the present invention is to provide an outboard motor capable of separating moisture from outside air flowing through an inside of a casing.

Another object of the present invention is to provide an outboard motor by which formation of rust on a metal-made component can be avoided.

According to an embodiment of the present invention, there is provided an outboard motor housing therein an engine, the outboard motor comprising:

an engine cover having formed therein a first outside air inlet port positioned on a front side in an advancing direction of a vessel, an exhaust port positioned rearward of the first outside air inlet port in the advancing direction, and a second outside air inlet port positioned on a side surface of the engine cover, the engine cover being configured to cover the engine;

a protective member configured to cover at least a rear side, in the advancing direction, of the engine;

a front side guide portion supported by the engine cover and configured to guide, downwardly in a gravity direction, outside air that has been introduced into the engine cover from the first outside air inlet port;

a rear side guide portion supported by the engine cover and configured to guide, downwardly in the gravity direction, outside air that has been introduced into the engine cover from the second outside air inlet port; and a lower housing arranged below the engine cover and configured to, together with the engine cover, define an engine chamber, a lower end portion of the rear side guide portion being positioned more upward than a bottom portion of the engine is.

Although the outside air that has been taken into the engine cover via the first outside air inlet port and the second outside air inlet port is high-humidity air including much humidity, if the above-described configuration has been adopted, the outside air will undergo gas-liquid separation in a process of being guided into the front side guide portion or the rear side guide portion. As a result, low-humidity cooling air can be brought into contact with the engine. It therefore becomes difficult for rust or corrosion to occur in components configuring the engine or other metal-made components. In other words, in the outboard motor employed on fresh water or sea water, concern that rust will occur can be dispelled.

Preferably, the lower housing has a storage portion formed therein, and a lower end portion of the front side guide portion is faced onto this storage portion. As a result, it becomes possible for moisture that has been separated from the outside air to be stored in a place separate from the engine. Note that, in order for the outside air from which humidity (moisture) has been separated to flow through toward the engine chamber easily, preferably, a clearance is pre-formed between the lower end portion of the front side guide portion and a side wall of the storage portion.

Preferably, a bottom wall of the storage portion has a drain port formed therein. Due to moisture that has been stored in the storage portion being discharged from the drain port, the moisture can easily be discharged to outside of the lower housing.

A configuration may be adopted whereby the drain port is provided with a foreign body intrusion preventing unit. As a result, a foreign body is prevented from intruding into an inside of the lower housing from outside via the drain port.

In the case of the lower housing being configured by combining a plurality of members, there is a need for increasing seal performance of the places where the members are combined. Accordingly, it is preferable for the lower housing to comprise a single member. As a result, concern that leakage will occur from the lower housing itself, is dispelled.

Typically, the exhaust port opens on an upper surface of the engine cover, and the second outside air inlet port opens on a side portion of the engine cover. As a result, the cooling air will easily flow through an inside of the engine chamber.

Between the lower housing and the engine cover, there is provided a seal member for sealing between the two. In this case, it is preferable to adopt the seal member including: a base which seats on the lower housing and on which a lower end surface of the engine cover seats; a fitting portion that is continuous with the base and has formed therein a fitting groove to be fitted on to an edge portion of the lower housing; and a tongue piece portion that projects from the fitting portion and interposes between the fitting portion and the engine cover.

As may be understood from the above, the space between the lower housing and the engine cover is doubly sealed by the base and the tongue piece portion. Therefore, the space between the two is favorably sealed. Moreover, since an opening of the fitting groove faces downwards, it is difficult for water or the like to intrude into the fitting groove. Hence, the space between the two is even more favorably sealed.

DESCRIPTION OF EMBODIMENTS

A preferred embodiment of an outboard motor according to the present invention will be presented and described in detail below with reference to the accompanying drawings. Note that "front", "rear", "left", and "right" in the following description and drawings indicate frontward, rearward, leftward, and rightward as observed by a steersman gripping a steering wheel of a vessel.

Figure 1:
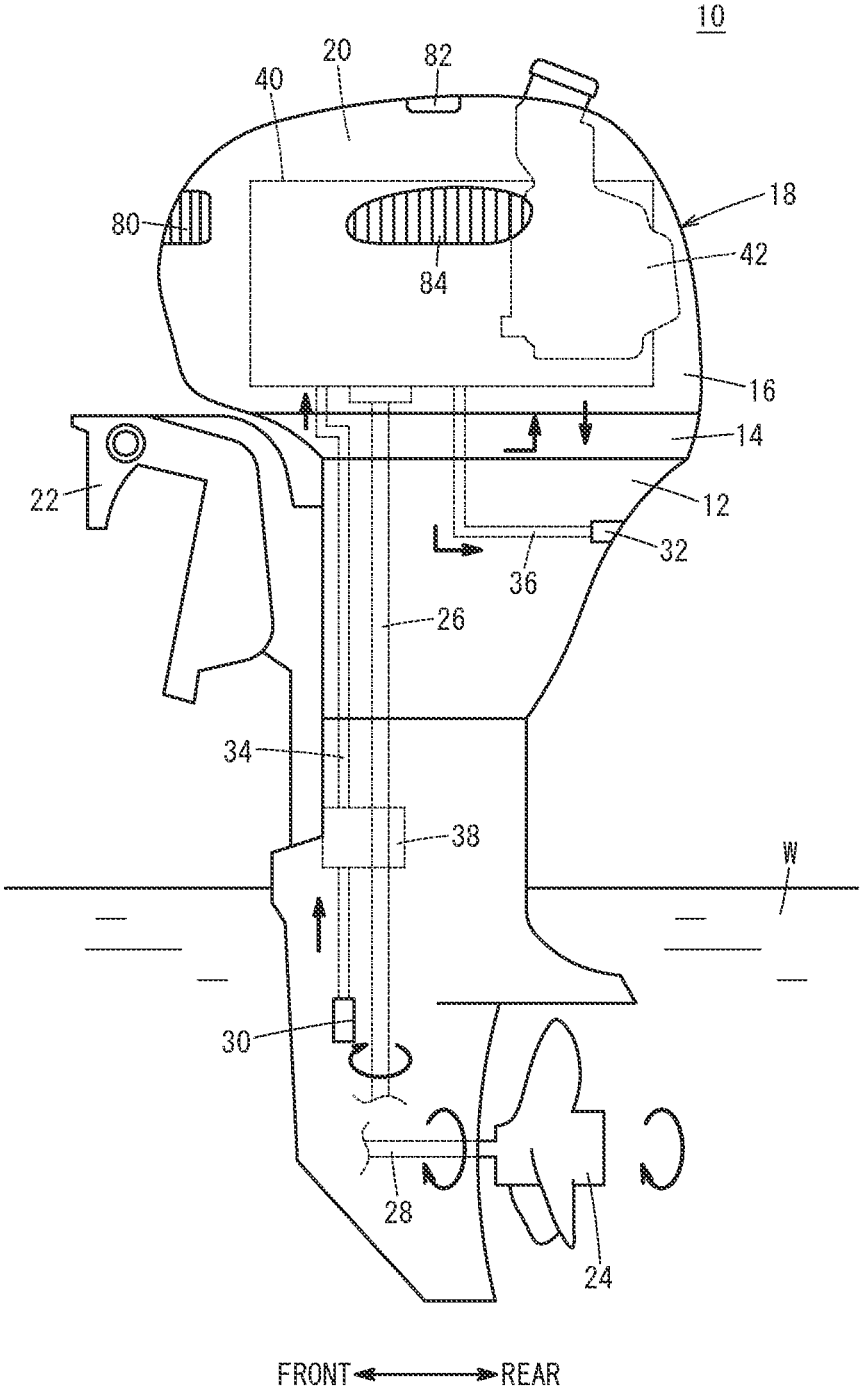
FIG. 1 is a schematic overall side view of an outboard motor according to an embodiment of the present invention.

FIG. 1 is a schematic overall side view of an outboard motor 10 according to the present embodiment. This outboard motor 10, which is employed by being fitted to an unillustrated vessel operated on water W, has a casing 18 which is configured including: a shaft cover 12; an under-case 14 being a lower housing; and an engine cover 16. An inner chamber defined by the under-case 14 and the engine cover 16 serves as an engine chamber 20. Moreover, the shaft cover 12 is provided with a clamp hook 22 for installing the outboard motor 10 in the vessel.

A screw 24 is arranged in a rotatable manner in a lower portion of the shaft cover 12, and a drive shaft 26 for rotating the screw 24 is housed inside the shaft cover 12. The drive shaft 26 and the screw 24 are coupled via a gear which is not illustrated and a propeller shaft 28. As a result, the propeller shaft 28 and the screw 24 rotate following the rotation of the drive shaft 26.

On a side surface and a rear surface of the shaft cover 12, there respectively open a water intake port 30 and a water discharge port 32. Moreover, the inside of the shaft cover 12 has formed therein: a water supply channel 34 that extends substantially parallelly to the drive shaft 26 from the water intake port 30 toward an engine 40; and a water discharge channel 36 that heads for the water discharge port 32 from the engine 40. The water supply channel 34 is provided with a water pump 38 in a vicinity of the water intake port 30.

The engine chamber 20 houses the engine 40 and a fuel tank 42. The fuel tank 42 supplies a fuel to the engine 40. The fuel combusts within the engine 40 whereby the engine 40 is operated and the drive shaft 26 rotates, and the propeller shaft 28 and the screw 24 rotate following the rotation of the drive shaft 26.

Figure 2:
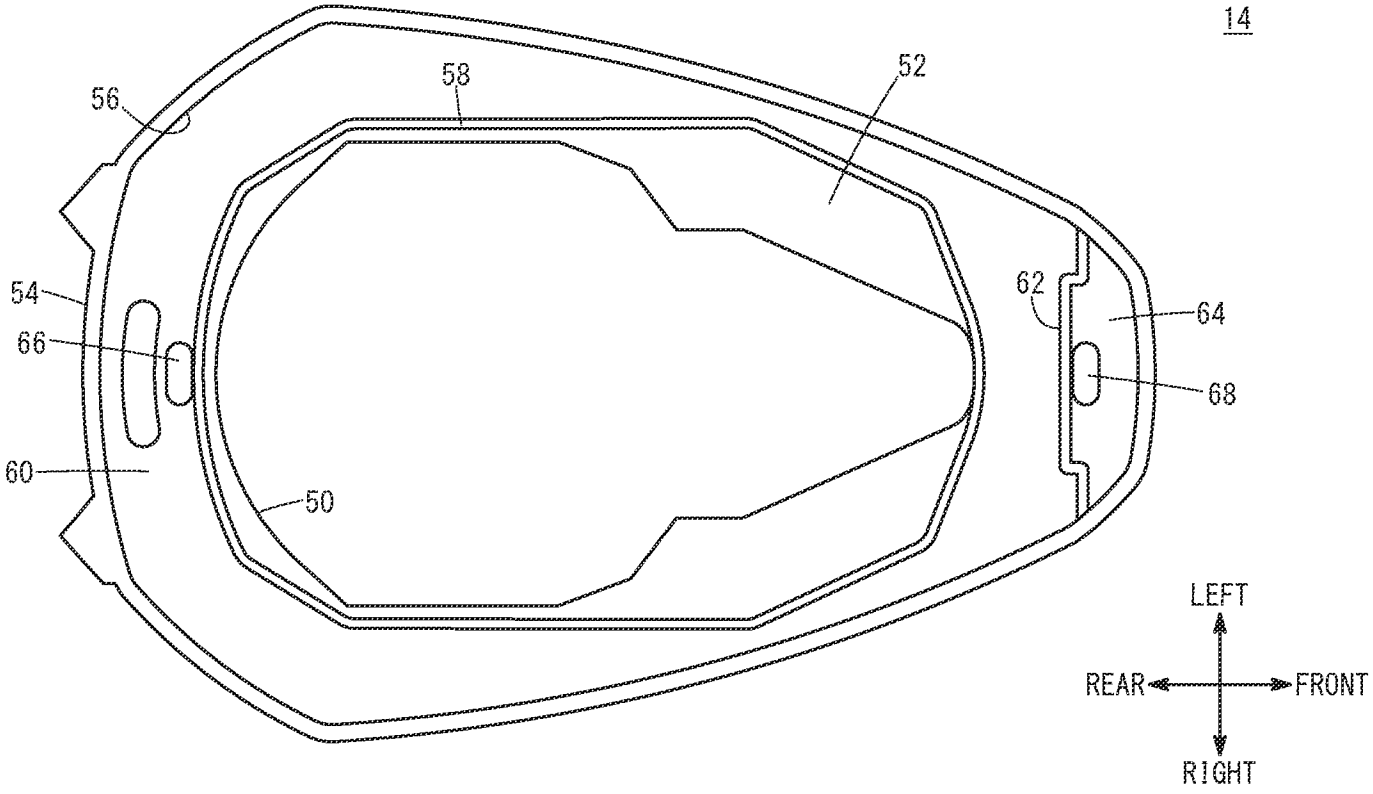
FIG. 2 is a schematic plan view of a lower housing (an under-case) configuring a casing of the outboard motor.

Now, a schematic plan view of the under-case 14 interposing between the shaft cover 12 and the engine cover 16, is shown in FIG. 2. The under-case 14 integrally has: a substantially circular ring-shaped bottom wall portion 52 having formed therein a lower portion opening 50; and a side wall portion 54 that rises up from the bottom wall portion 52 to circle the bottom wall portion 52. Whereas an under-cover in conventional technology is configured by coupling a right-side half body and a left-side half body, in the present embodiment, the under-case 14 is configured from a single member. Above the side wall portion 54, there is formed an upper portion opening 56 which has a larger area than the lower portion opening 50.

A ring-like partitioning wall portion 58 rises up substantially parallelly to the side wall portion 54 from a vicinity of the lower portion opening 50, in the bottom wall portion 52. As a result, a circular ring-shaped main storage portion 60 is formed by the side wall portion 54 and the ring-like partitioning wall portion 58. A demarcating wall portion 62 rises up from the bottom wall portion 52 at a place thereof close to a forward side of the side wall portion 54, and a sub storage portion 64 of small capacity is formed by the demarcating wall portion 62 and the forward side of the side wall portion 54. The bottom wall portion 52 has further formed therein a rearward drain port 66 and a frontward drain port 68 for discharging liquid that has been stored in the main storage portion 60 and the sub storage portion 64, respectively.

Figure 4:
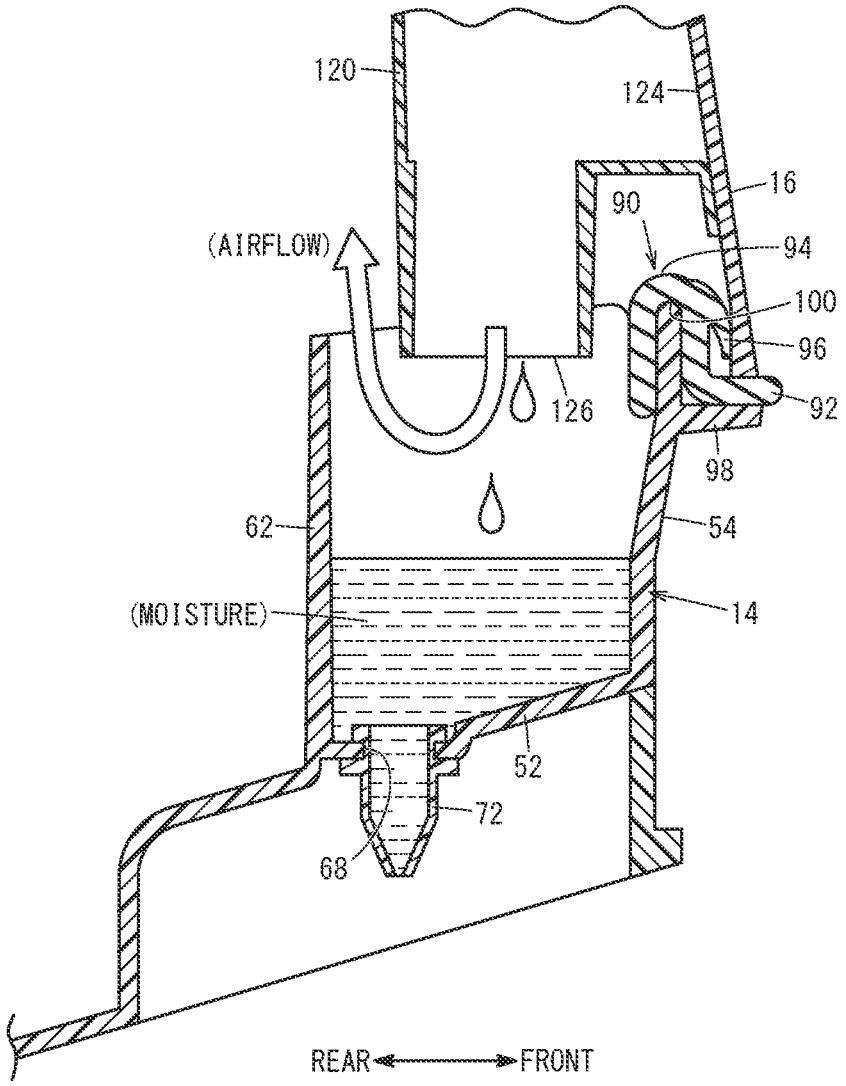
FIG. 4 is a principal-parts enlarged longitudinal cross-sectional view of a vicinity of a coupling place of the lower housing and the engine cover on a front side in an advancing direction of a vessel.

Grommets 70, 72 as foreign body intrusion preventing units are respectively fitted to the rearward drain port 66 and the frontward drain port 68 (refer to FIG. 4 in particular). The grommets 70, 72 allow moisture of the main storage portion 60 or the sub storage portion 64 (both of which are inside the under-case 14) to flow out to outside of the under-case 14 via the rearward drain port 66 and the frontward drain port 68. On the other hand, the grommets 70, 72 prevent a foreign body such as sea water from entering the main storage portion 60 or the sub storage portion 64 via the rearward drain port 66 and the frontward drain port 68 from outside of the under-case 14.

Figure 3:
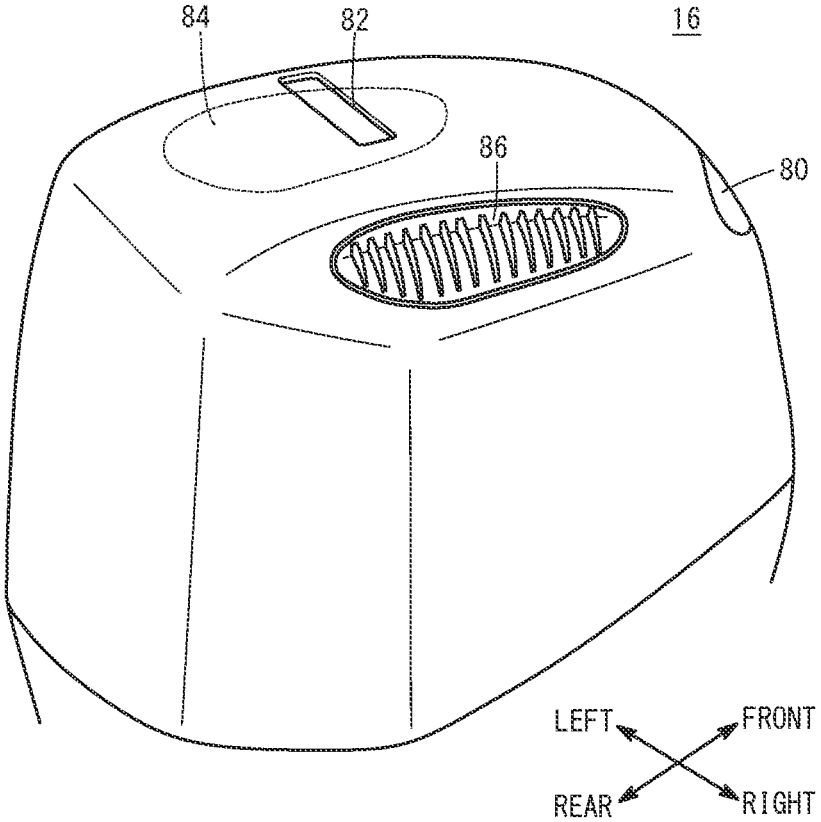
FIG. 3 is a schematic perspective view of an engine cover configuring the casing of the outboard motor.

FIG. 3 is a schematic perspective view of the engine cover 16 arranged above the under-case 14. The engine cover 16 has a first outside air inlet port 80 formed on its front surface side, and has an exhaust port 82 formed on its upper surface at substantially a central portion in a front-rear direction thereof. In addition, the engine cover 16 has a left second outside air inlet port 84 and a right second outside air inlet port 86 respectively formed on its left side surface and its right side surface. In this case, the left second outside air inlet port 84 and the right second outside air inlet port 86 extend in such a manner that their front side end portions are each positioned more to a front side than the exhaust port 82 is, and their rear side end portions are each positioned more to a rear side than the exhaust port 82 is.

The space between the under-case 14 and the engine cover 16 is sealed by a ring-like seal member 90 shown in FIG. 4. This ring-like seal member 90 has a base 92, a fitting portion 94, and a tongue piece portion 96. First, the base 92 seats on a frontward fin 98 provided integrally with the under-case 14. A lower end surface of the engine cover 16 seats on this base 92. In other words, the base 92 is sandwiched by the under-case 14 (the frontward fin 98) and the engine cover 16.

Moreover, the fitting portion 94 has a region continuous with the base 92, and a region continuous with this region in a substantially 360° inverted manner, and, due to this inversion, is shaped such that a fitting groove 100 is formed between the two regions. An upper edge portion of the side wall portion 54 of the under-case 14 is fitted into the fitting groove 100. Due to this fitting and the previously described sandwiching, it becomes difficult for the ring-like seal member 90 to drop out from between the under-case 14 and the engine cover 16. Note that due to such fitting being performed, an opening of the fitting groove 100 faces downwards.

The tongue piece portion 96 is continuous with the fitting portion 94 so as to project to the engine cover 16 side. Hence, the tongue piece portion 96 is crushed by interposing between the engine cover 16 and the region of the fitting portion 94 that is continuous with the base 92. In other words, the tongue piece portion 96 is sandwiched by the fitting portion 94 and the engine cover 16. By the base 92 interposing between the under-case 14 (the frontward fin 98) and the engine cover 16 and the tongue piece portion 96 interposing between the fitting portion 94 and the engine cover 16, the space between the under-case 14 and the engine cover 16 is doubly sealed. Hence, seal performance will be favorable.

Figure 5:
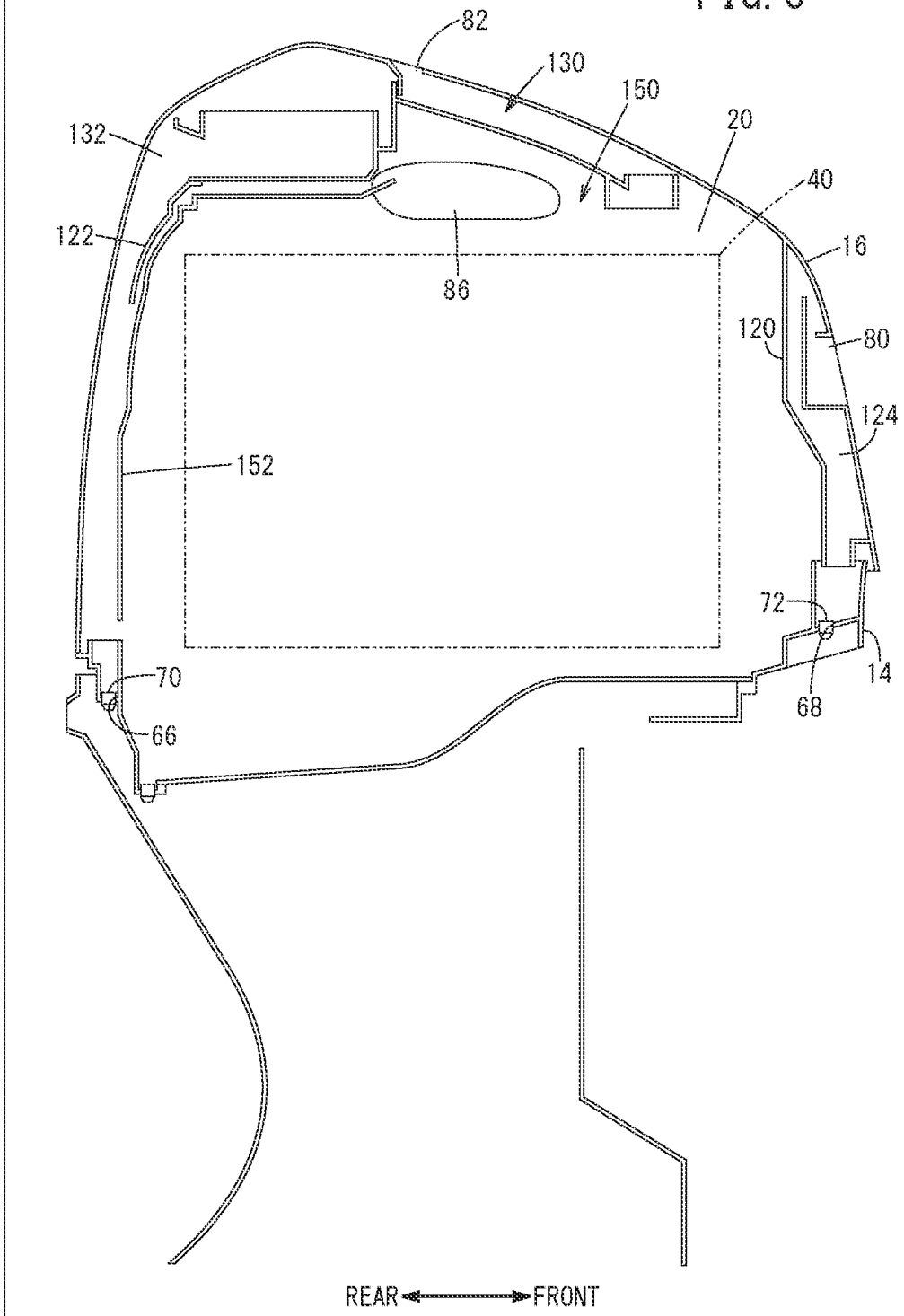
FIG. 5 is principal-parts side cross-sectional view taken along a front-rear direction of the outboard motor.
Figure 6:
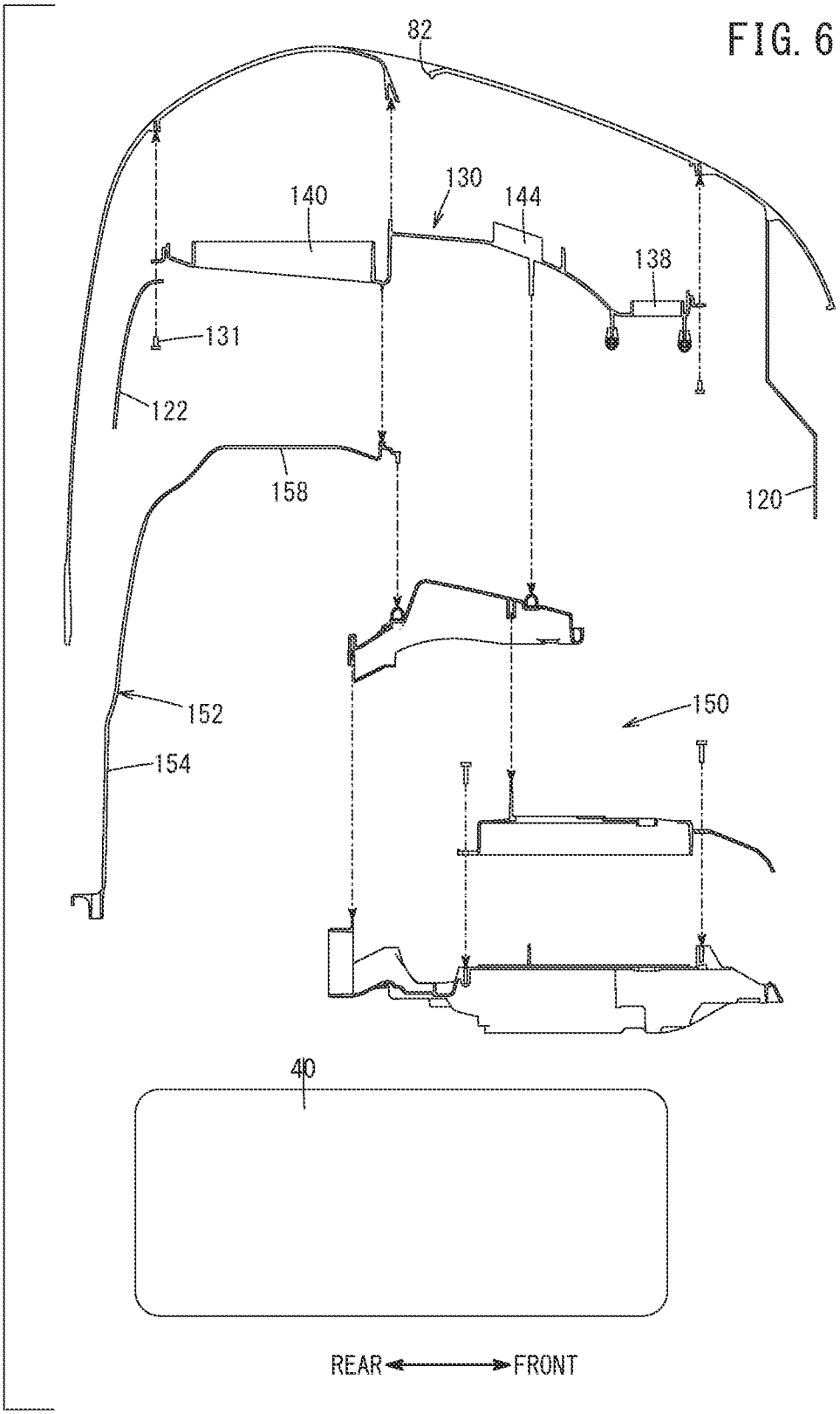
FIG. 6 is a principal-parts side exploded view taken along the front-rear direction of the outboard motor.

FIGS. 5 and 6 are a principal-parts side cross-sectional view and a principal-parts side exploded view taken along the front-rear direction of the engine chamber 20. A front duct 120 being a front side guide portion and a rear duct 122 being a rear side guide portion are provided so as to hanging substantially downward on a front side and a rear side of an inside (the engine chamber 20) of the engine cover 16, respectively. The front duct 120 of these two ducts is coupled via a screw (not illustrated) to an inner surface of a ceiling wall of the engine cover 16. In other words, the front duct 120 is supported by the engine cover 16. A frontward lead channel 124 is formed by the front duct 120 and a front surface wall of the engine cover 16.

As shown in FIG. 4, a frontward portion of a lower end of the front duct 120 abuts on the front surface wall of the engine cover 16. Moreover, at the lower end of the front duct 120, there is formed a discharge opening 126 of the frontward lead channel 124. The sub storage portion 64 is positioned below the discharge opening 126. The sub storage portion 64 is of broader width compared to the discharge opening 126, and, as a result, it becomes possible for an airflow (outside air) led out from the discharge opening 126 to flow out from between the front duct 120 and the demarcating wall portion 62.

The other of the two ducts, that is, the rear duct 122 is coupled via a screw 131 to a rear end portion of an air guide 130 interposing between the engine 40 and the engine cover 16. Since the air guide 130 is coupled to the engine cover 16 via the screw 131, the rear duct 122 is indirectly supported by the engine cover 16 via the air guide 130. The rear duct 122 and a rearward wall portion of the engine cover 16 are separated by a certain interval, whereby a rearward lead channel 132 is formed between the rear duct 122 and the rearward wall portion of the engine cover 16. A hanging-down length of the rear duct 122, in other words, a trailing end of the rearward lead channel 132 is set to be more upward than a bottom surface of the engine 40, typically, more upward than a middle portion in a height direction of the engine 40.

Figure 7:
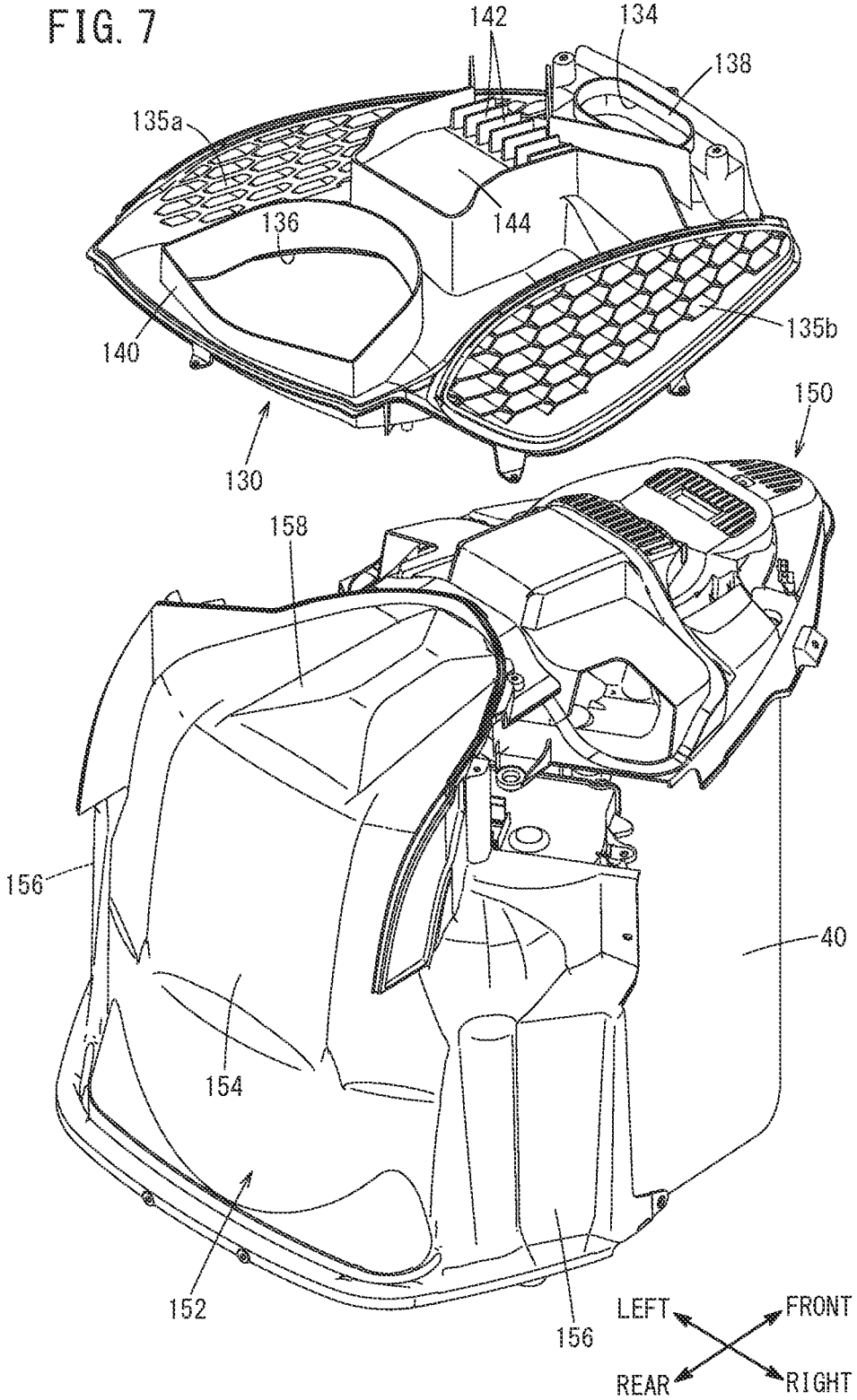
FIG. 7 is a principal-parts exploded perspective view of a rear side of the outboard motor.
Figure 8:
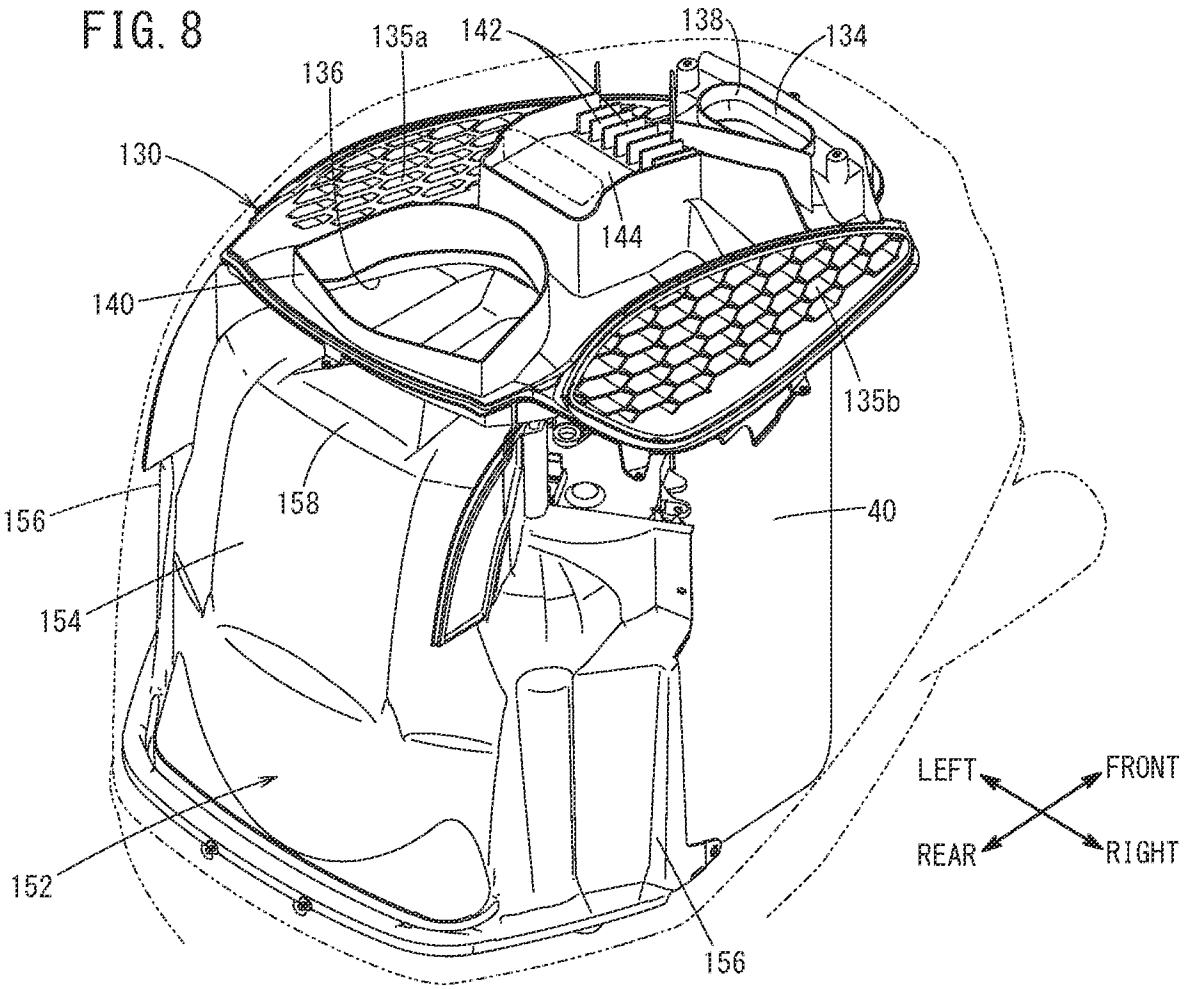
FIG. 8 is principal-parts assembled perspective view of the rear side of the outboard motor.

As shown in detail in FIG. 7 which is a principal-parts exploded perspective view and FIG. 8 which is a principal-parts assembled perspective view, an outlet communicating port 134 which is substantially long hole-shaped opens on a frontward side of the air guide 130, and a left inlet communicating port 135*a* and a right inlet communicating port 135*b* which are honeycomb-shaped open on sides of the air guide 130. Furthermore, on a rear side of the air guide 130, there is formed a lead port 136 for supplying intake air (outside air) to the rearward lead channel 132. In peripheries of the outlet communicating port 134 and the lead port 136, there rise up an outlet side lead wall 138 and an inlet side lead wall 140. Note that in FIGS. 7 and 8, illustration of the rear duct 122 provided in the air guide 130 is omitted.

The outlet communicating port 134 is arranged at a position displaced forwardly from the exhaust port 82 (refer to FIG. 3). Note that directly under the exhaust port 82, there is positioned a guiding portion 144 which is provided with lead fins 142 that extend from a front side toward a rear side.

A fan cover 150 (refer to FIGS. 5 and 6) is provided between the air guide 130 and the under-case 14. As may be understood from FIG. 6, the fan cover 150 is configured by three members being coupled. The fan cover 150 covers an unillustrated cooling fan, and thereby protects the cooling fan.

As shown in FIGS. 7 and 8, on a rearward side of the engine 40, there is arranged an engine guard 152 (a protective member) that covers and thereby protects the engine 40. The engine guard 152 interposes between the engine 40 and the engine cover 16 and has a rear surface guard portion 154 that covers the whole of a rear surface of the engine 40, two side surface guard portions 156 that project from the rear surface guard portion 154 while being bent so as to go round to side surfaces of the engine 40, and an upper surface guide portion 158 that extends from the rear surface guard portion 154 while being bent so as to go round to an upper surface of the engine 40. Therefore, the rear duct 122 is positioned in a space formed between the rear surface guard portion 154 of the engine guard 152 and the engine cover 16 (refer to FIG. 5). Moreover, a region of the air guide 130 where the lead port 136 has been formed is positioned above the upper surface guard portion 158 (refer to FIG. 8).

The outboard motor 10 according to the present embodiment is basically configured as above, and operational advantages thereof will be described next.

When the vessel is operated on the water W such as a lake/marsh, river, bay, or ocean, the engine 40 configuring the outboard motor 10 is energized. Due to this energization, the fuel is supplied to the engine 40 from the fuel tank 42, and the fuel combusts within the engine 40. Upon the engine 40 being operated in this way, the drive shaft 26 rotates, whereby the propeller shaft 28 coupled to the drive shaft 26 rotates following the rotation of the drive shaft 26, and, moreover, the screw 24 rotates. As a result of this rotation, a propulsive force on the vessel is realized.

Moreover, the water pump 38 is energized simultaneously to operation start of the engine 40. As a result, the water W (fresh water when a place of operation is a lake/marsh or river, and sea water when the place of operation is a bay or ocean) is drawn up via the water intake port 30, and flows through the water supply channel 34 as cooling water. The cooling water is supplied to the engine 40, and after having cooled the engine 40, passes along the water discharge channel 36 to be discharged from the water discharge port 32.

Furthermore, outside air is introduced into the engine cover 16 from the first outside air inlet port 80, the left second outside air inlet port 84, and the right second outside air inlet port 86 respectively formed on the front surface, the left side surface, and the right side surface of the engine cover 16. The outside air that has been introduced flows through the inside of the engine cover 16 (the engine chamber 20) to become the cooling air that cools the engine 40, and so on. Since the vessel is operated on the water W, the outside air immediately after having been introduced into the engine cover 16 from the first outside air inlet port 80, the left second outside air inlet port 84, and the right second outside air inlet port 86 is a gas-liquid two-phase flow that includes humidity.

The outside air that has been introduced from the first outside air inlet port 80 (hereafter, also written as "frontward cooling air") advances slightly to the rear side to contact the front duct 120. Since the front duct 120 extends toward the under-case 14 side, that is, downwardly, an advancing direction of the frontward cooling air changes to downwards. In other words, the frontward cooling air flows through to the under-case 14 side along an extension direction of the frontward lead channel 124.

Therefore, the frontward cooling air stays for a comparatively long time within the frontward lead channel 124. While staying within the frontward lead channel 124 in this way, the frontward cooling air contacts the front duct 120 or the frontward wall portion of the engine cover 16 to undergo gas-liquid separation. That is, it separates into moisture and airflow. The separated moisture falls into the sub storage portion 64 from the discharge opening 126 of the frontward lead channel 124 (refer to FIG. 4 in particular) under action of gravity.

The bottom wall portion 52 forming the sub storage portion 64 has the frontward drain port 68 formed therein as described above. The moisture that has fallen into the sub storage portion 64 is discharged to outside of the engine cover 16 via the grommet 72 provided in the frontward drain port 68. Note that since the grommet 72 is protecting the frontward drain port 68, a foreign body such as the water W or dust is prevented from intruding into the sub storage portion 64 from outside of the engine cover 16 via the frontward drain port 68.

Figure 9:
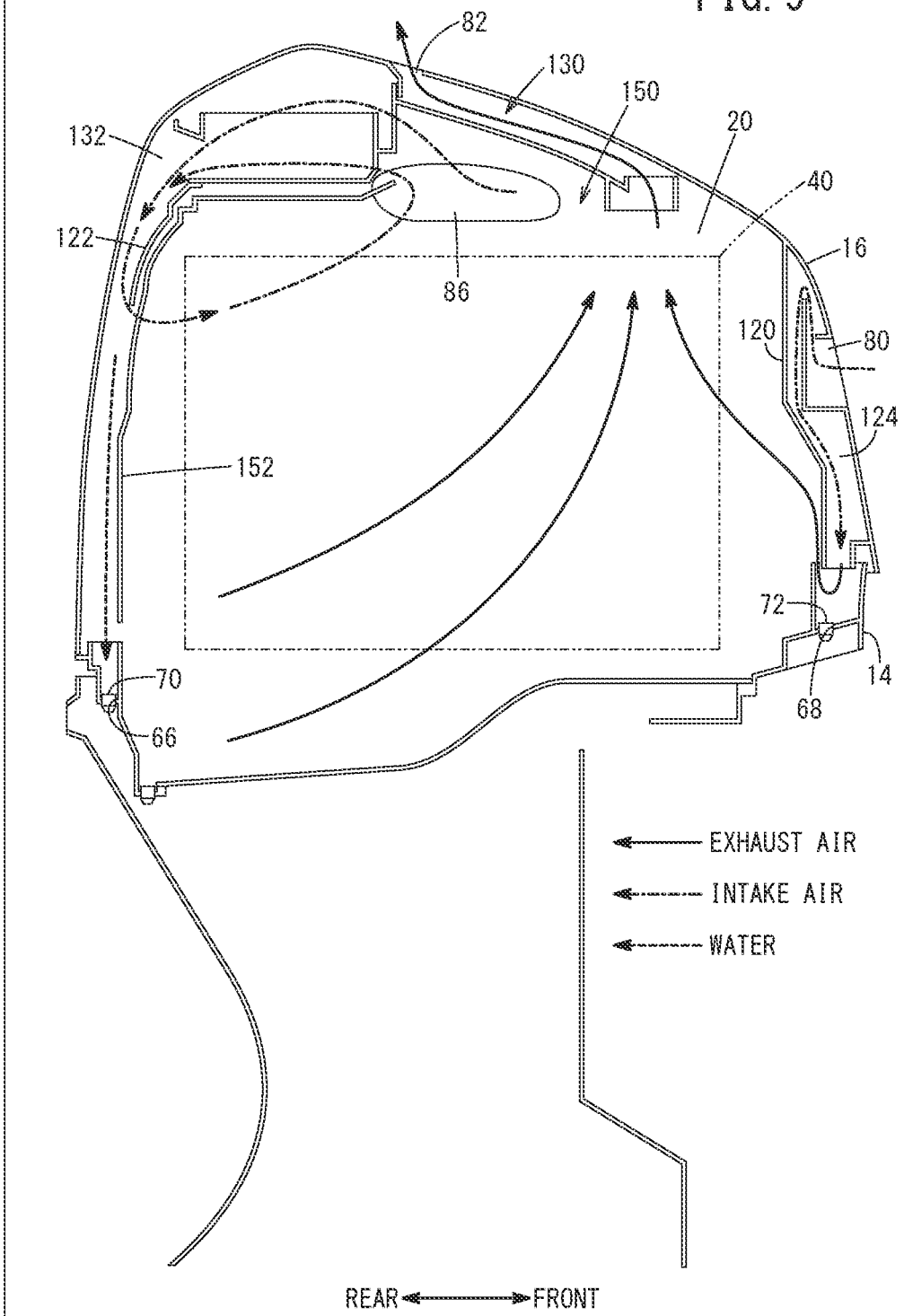
FIG. 9 is a principal-parts side cross-sectional view showing a flow-through process of outside air that has been introduced into the engine cover from a first outside air inlet port.

Since the sub storage portion 64 is of broader width compared to the discharge opening 126, a clearance is formed between the discharge opening 126 and an upward opening of the sub storage portion 64. The frontward cooling air (the airflow) from which the moisture has been removed passes through this clearance and is sucked in by negative pressure air intake action of the cooling fan to thereby rise mainly along frontward side surfaces of the engine 40. The above flow-through process is shown in FIG. 9.

Figure 10:
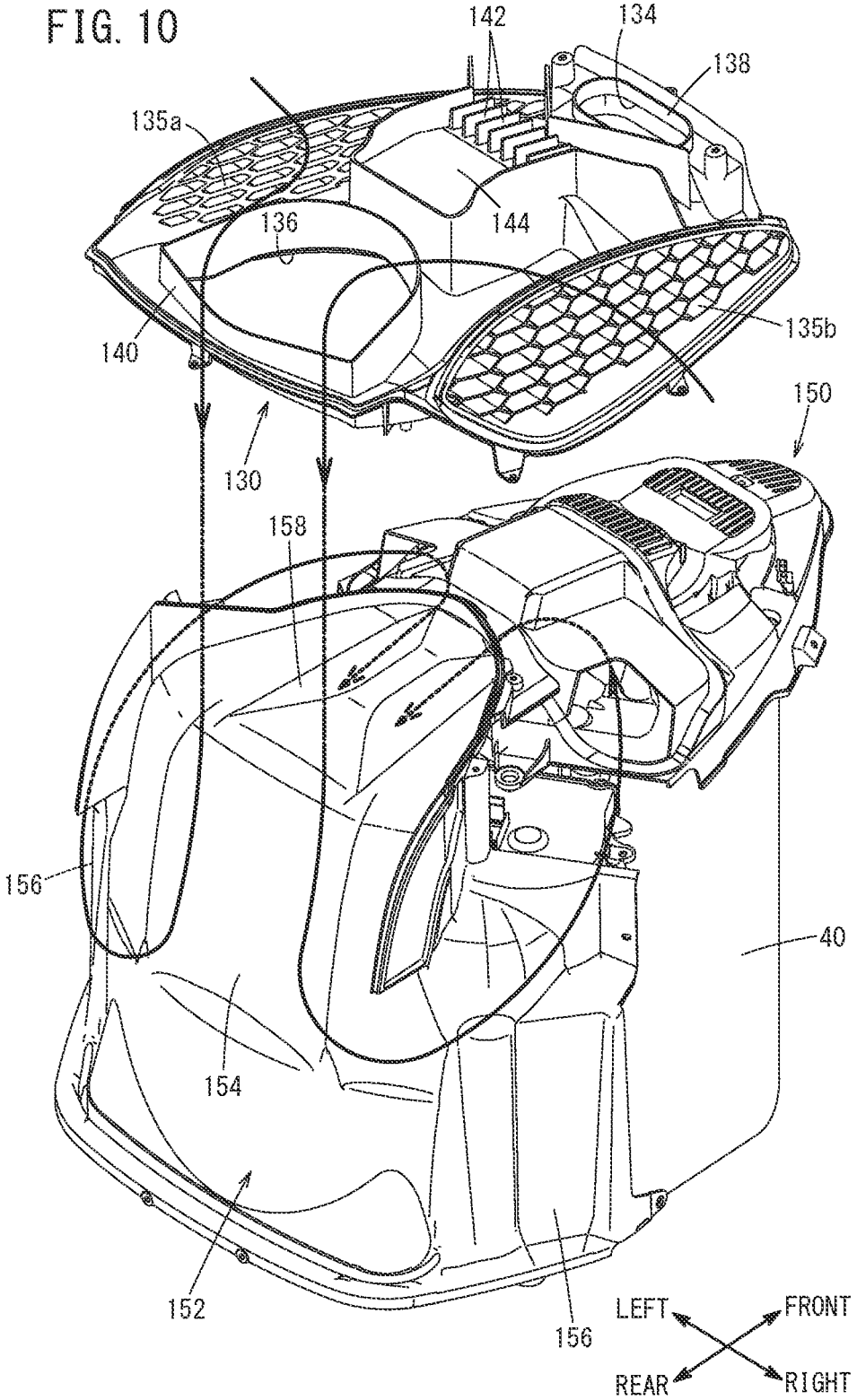
FIG. 10 is a principal-parts side cross-sectional view showing a flow-through process of outside air that has been introduced into the engine cover from a second outside air inlet port.

On the other hand, the outside air that has been introduced from the left second outside air inlet port 84 and the outside air that has been introduced from the right second outside air inlet port 86 pass through the left inlet communicating port 135*a* and the right inlet communicating port 135*b* of the air guide 130, and merge in a space between these left inlet communicating port 135*a* and right inlet communicating port 135*b*, as shown in FIG. 10. Hereafter, the merged outside air will also be written as "rearward cooling air". The rearward cooling air further passes through the lead port 136, and then, while being guided by the downwardly extending rear duct 122, advances descending toward the under-case 14. That is, the rearward cooling air flows through to the under-case 14 side along an extension direction of the rearward lead channel 132.

While staying within the rearward lead channel 132, the rearward cooling air contacts a rearward wall portion of the engine cover 16 or the upper surface guard portion 158 or the rear surface guard portion 154 of the engine guard 152 to undergo gas-liquid separation, and separate into moisture and airflow. The separated moisture descends under action of gravity, and falls into the main storage portion 60 (refer to FIG. 2) positioned below the rearward lead channel 132.

The moisture that has fallen into the main storage portion 60 is discharged to outside of the engine cover 16 via the rearward drain port 66 formed in the bottom wall portion 52 forming the main storage portion 60, and the grommet 70. Since the grommet 70 is protecting the rearward drain port 66, a foreign body such as the water W or dust is prevented from intruding into the main storage portion 60 from outside of the engine cover 16 via the rearward drain port 66, similarly to as described above.

The lower end of the rear duct 122, in other words, the trailing end of the rearward lead channel 132 is set to be more upward than the middle portion in the height direction of the engine 40. Therefore, the rearward cooling air that has been led out from the rearward lead channel 132 is sucked in by negative pressure air intake action of the cooling fan to rise while going round to the side surface guard portions 156 from the rear surface guard portion 154 of the engine guard 152. Further, the rearward cooling air further enters the clearance between the upper surface guard portion 158 and the upper surface of the engine 40. Due to the above flow-through process, the rearward cooling air mainly cools rearward side surfaces and a rearward upper surface of the engine 40. That flow-through process is shown in FIGS. 9 and 10.

The frontward cooling air and the rearward cooling air that have finished cooling of the engine 40 are led out to between the air guide 130 and the ceiling wall of the engine cover 16 from the outlet communicating port 134. The frontward cooling air and the rearward cooling air further flow through to the guiding portion 144 by means of the lead fins 142, and are then discharged to outside of the engine cover 16 from the exhaust port 82. By the above flow-through process being continued during operation of the vessel, the inside of the engine chamber 20, in particular, the engine 40, is efficiently cooled.

Moreover, the frontward cooling air and the rearward cooling air contacting the engine 40 have their moisture removed as described above, and so attain low humidity. That is, due to the front duct 120 and the rear duct 122 being provided, the outside air flowing through the inside of the engine chamber 20 (the frontward cooling air and the rearward cooling air) can undergo dehumidification. As a result, concern that rust or corrosion will occur in components configuring the engine 40 or other metal-made components, is dispelled.

Additionally, in the present embodiment, the under-case 14 comprises a single member. Therefore, airtightness or liquid-tightness of the under-case 14 itself will be favorable. That is, occurrence of leakage from the under-case 14 is avoided.

Moreover, in the present embodiment, a seal member having the base 92, the fitting portion 94, and the tongue piece portion 96 is provided between the under-case 14 and the engine cover 16 (refer to FIG. 4). In this case, double sealing is performed by the base 92 and the tongue piece portion 96, so the space between the under-case 14 and the engine cover 16 is favorably sealed. That is, it is difficult for leakage to occur from between the two member 14 and 16.

Furthermore, since the upper edge portion of the side wall portion 54 of the under-case 14 is fitted into the fitting groove 100, the opening of the fitting groove 100 faces the under-case 14 side, that is, downwards. Therefore, it becomes difficult for a foreign body such as the water W to enter the fitting groove 100. This too contributes to improvement in seal performance between the two members 14 and 16.

The present invention is not specifically limited to the above-described embodiment, and a variety of modifications are possible in a range not departing from the spirit of the present invention.

For example, a configuration may be adopted in which a check valve is employed as the foreign body intrusion preventing unit.

Moreover, a configuration may be adopted in which an under-cover configured by combining a plurality of members is employed.

What is claim is:

1. An outboard motor housing therein an engine, the outboard motor comprising:

an engine cover having formed therein a first outside air inlet port positioned on a front side in an advancing direction of a vessel, an exhaust port positioned rearward of the first outside air inlet port in the advancing direction, and a second outside air inlet port positioned on a side surface of the engine cover, the engine cover being configured to cover the engine;

a protective member configured to cover at least a rear side, in the advancing direction, of the engine;

a front side guide portion supported by the engine cover and configured to guide, downwardly in a gravity direction, outside air that has been introduced into the engine cover from the first outside air inlet port;

a rear side guide portion supported by the engine cover and configured to guide, downwardly in the gravity direction, outside air that has been introduced into the engine cover from the second outside air inlet port; and a lower housing arranged below the engine cover and configured to, together with the engine cover, define an engine chamber, a lower end portion of the rear side guide portion being positioned more upward than a bottom portion of the engine is.

2. The outboard motor according to claim 1, wherein a storage portion is formed in the lower housing, a lower end portion of the front side guide portion faces the storage portion, and a clearance is formed between the lower end portion of the front side guide portion and a side wall of the storage portion.

3. The outboard motor according to claim 2, wherein a drain port is formed in a bottom wall of the storage portion.

4. The outboard motor according to claim 3, wherein the drain port is provided with a foreign body intrusion preventing unit configured to prevent a foreign body from intruding into an inside of the lower housing from outside via the drain port.

5. The outboard motor according to claim 1, wherein the lower housing comprises a single member.

6. The outboard motor according to claim 1, wherein the exhaust port opens on an upper surface of the engine cover, and the second outside air inlet port opens on a side portion of the engine cover.

7. The outboard motor according to claim 1, further comprising a seal member that interposes between the lower housing and the engine cover, wherein the seal member includes: a base which seats on the lower housing and on which a lower end surface of the engine cover seats; a fitting portion that is continuous with the base and has formed therein a fitting groove into which an edge portion of the lower housing is fitted; and a tongue piece portion that projects from the fitting portion and interposes between the fitting portion and the engine cover.

* * * * *